United States Patent [19]

Fukui

[11] Patent Number: 4,496,145

[45] Date of Patent: Jan. 29, 1985

[54] SHEET FEEDING APPARATUS

[75] Inventor: Kazuyuki Fukui, Toyohashi, Japan

[73] Assignee: Minolta Camera Kabushiki Kaisha, Azuchi, Japan

[21] Appl. No.: 357,318

[22] Filed: Mar. 11, 1982

[30] Foreign Application Priority Data

Mar. 14, 1981 [JP] Japan ..... 56-38093

[51] Int. Cl.[3] ..... B65H 3/52

[52] U.S. Cl. ..... 271/122; 271/34

[58] Field of Search ..... 271/34, 35, 121, 122, 271/125, 167

[56] References Cited

U.S. PATENT DOCUMENTS 2,635,874 4/1953 LaBore ..... 271/35
4,208,046 6/1980 Shimizu et al. ..... 271/122
4,239,203 12/1980 Uchida ..... 271/122

*Primary Examiner*—Richard A. Schacher
*Attorney, Agent, or Firm*—Wenderoth, Lind & Ponack

[57] ABSTRACT

An automatic sheet feeding apparatus for use in a copying machine and the like having a sheet separating members. The separating members include a sheet feeding rotatable member, a separating rotatable member and a follower rotatable member, with the feeding rotatable member in contact with both the separating member and the follower rotatable member. The feeding rotatable member has a peripheral surface which is harder than that of the separating rotatable member. The follower rotatable member has its peripheral surface of a material having a coefficient of friction smaller than that of the other members. The width of the contact area between the separating rotatable member and feeding rotatable member is larger than that between the follower rotatable member and the feeding rotatable member.

16 Claims, 14 Drawing Figures

SHEET FEEDING APPARATUS

BACKGROUND OF THE INVENTION

The present invention generally relates to a feeding arrangement for sheets such as copy paper sheets and the like and more particularly, to an automatic sheet feeding apparatus for use, for example, in a copying machine, facsimile equipment, printer, etc.

Conventionally, there has been provided, for example, an automatic copying sheet feeding apparatus for use in an electrophotographic copying machine as shown in FIG. 1. The automatic copying sheet feeding apparatus of FIG. 1 comprises a platform or hopper base 1 for accommodating therein a stack of copying sheets 6, a driven roller 2 arranged to rotate clockwise for feeding a single uppermost sheet with or without a few other sheets thereunder from the hopper base 1, and a sheet separating means M, including an upper roller 3 for forward rotation serving as a feeding roller which is made of normal rubber material and which rotates in the direction of advance of the sheet and rotates to feed the single uppermost sheet towards a pair of conveyance rollers 5 and a lower roller 4 for reverse rotation serving as a separating roller which is made of expanded rubber material and which rotates in the direction opposite to movement of the sheets to prevent other sheets below the single uppermost sheet from moving forward beyond the separating means. The feeding roller 3 has its peripheral surface provided with a material having a coefficient of friction larger than that of the separating roller 4.

However, the automatic sheet feeding apparatus as described above has disadvantages as follows.

Since the rollers 3 and 4 are made of normal rubber material or expanded rubber material, as described above, these rollers 3 and 4 can sometimes repel each other so that the separating roller 4 oscillates or moves upwardly and downwardly with respect to the upper roller 3, thus resulting in variation of contact pressure against the feeding roller 3 and generation of noise, with consequent reduction in the sheet feeding force, and instability in the sheet separating function. Under the above circumstances, there may arise such inconvenience that some sheets fail to reach the conveyance rollers 5 or become jammed around the separating means, and also that two or more sheets may be fed to the conveyer rollers 5 beyond the separating means at the same time. The problem as described above can not be solved merely by strengthening the contact pressure between the rollers 3 and 4.

If the contact pressure between the rollers 3 and 4 is increased the oscillation of the separating roller 4 becomes more violent, while the peripheral surface of the separating roller 4 is abraded excessively. Additionally the sheets, if they are very thin, may become winkled or folded.

Under such a circumstance as described above, if the driven roller 2 is kept rotating after the leading edge of the sheet has reached the rollers 3 and 4, the sheet forms a loop between the driven roller 2 and the separating means or the leading edge of the few other sheets fed with the single uppermost sheet are folded and jammed up in the space between the driven roller 2 and the separating means M. In order to avoid such a problem, it is necessary to provide a mechanism for stopping the rotation of the driven roller 2 after the leading edges of the sheets have reached the rollers 3 and 4, or additionally to incorporate into the driven roller 2 a unidirectional clutch which allows the driven roller 2 to rotate freely in the clockwise direction with respect to its rotating shaft. However, such a mechanism results in the complication of the sheet feeding apparatus.

It is to be noted that, in a specific type of an electrophotographic copying machine which is designed so as to transfer different toner images onto both sides of a sheet, the automatic sheet feeding apparatus therein is arranged so as to feed a sheet which has been transferred with a toner image on its one side for transferring another image onto its other side. Accordingly, some toner of the toner image transferred to the one side of the sheet unavoidably adheres to the peripheral surface of the feeding roller 3, so that the coefficient of friction of the roller is reduced by 20 to 50%. As a result, in such a type of apparatus, the sheet feeding force, as described above, is considerably reduced.

Conventionally, in order to avoid such problems as described above, there have been provided improved apparatuses as follows.

(a) In one of such improved apparatus, the conveyance rollers 5 are located as close to the rollers 3 and 4 as possible in order to receive the sheet from the separating means as soon as possible.

(b) In another improved apparatus, the driven roller 2 is movable away from the sheet at the time when the leading edge of the sheet has reached the feeding roller 3 in order to reduce or eliminate the resistance of the roller 2 against the sheet.

(c) In a further improved apparatus, the feeding roller 3 and the separating roller 4 are respectively divided into two or more parts in the axial direction thereof and arranged in such a manner that each part of the feeding roller 3 extends slightly into the space between the adjacent two parts of the separating roller. This type of apparatus is provided, for example, in Japanese Patent Publication Tokkaisho No. 50-40,603.

(d) In a still further improved apparatus, a minor clearance is formed between the rollers 2 and 3. This type of apparatus is provided, for example, in Japanese Laid Open Utility Model Application Jikkaisho No. 54-51,786.

These improved apparatuses as described above, however, respectively have the following drawbacks.

In the apparatus of the item (a), it is necessary to provide a number of conveyance rollers 5 in a limited space. In the apparatus of the item (b), it is necessary to provide a complicated mechanism for moving the hopper base 1 or the driven roller 2 upwardly and downwardly relatively each other. Such complicated mechanism may cause the deterioration of the reliability of the essential function of the driven roller 2 which is to feed the sheets forward one by one. In the apparatus of the item (c), it is very difficult to adjust the desired distance between the axes of the rollers 3 and 4. In the apparatus of the item (d), it is very difficult to adjust the width of the clearance, in other words, the contact pressure of each roller 3 and 4 with the sheet to be supplied so as to exactly correspond to the thickness of the sheet, especially for a thin and flexible sheet. In the event that the adjustment of the clearance is improper, the roller 3 and 4 will fail to contact the sheet under a suitable pressure. As a result, two or more sheets, may be frequently fed by the feeding roller 3 and a sheet may be jammed up around the rollers 3 and 4 in many cases.

SUMMARY OF THE INVENTION

Accordingly, an essential object of the present invention is to provide an automatic sheet feeding apparatus for use, for example, in a copying machine, facsimile equipment, printer or the like in which both the sheet feeding force and the sheet separating function are so stable that the sheets, even if different in size, quality and thickness, can be fed to the following step one by one with consequent elimination of disadvantages that sheet materials are jammed up or a plurality of sheets are fed to the following step at same time.

Another important object of the present invention is to provide an automatic sheet feeding apparatus of the above described type in which the oscillation and noise generated in the separating means can be reduced with simultaneous reduction of abrasive wear on the members of the separating means.

A further object of the present invention is to provide an automatic sheet feeding apparatus of the above described type which is simple in construction and can be readily incorporated into copying machines and the like at low cost.

In accomplishing these and other objects, according to one preferred embodiment of the present invention, there is provided an automatic sheet feeding apparatus which includes a hopper base for accommodating a stack of sheet material thereon, a driven roller for feeding the sheets in the hopper base forward one by one, a sheet separating means for receiving the sheets fed by the driven roller, separating a single uppermost sheet from other sheets below the uppermost sheet and feeding the single top sheet forward, and conveyance rollers for transporting the uppermost sheet fed by the separating means forward. The separating means further includes a feeding rotatable member which rotates in the direction of movement of the sheets to feed the single uppermost sheet forward, a separating rotatable member which contacts the feeding rotatable member and rotates in the direction opposite to the movement of sheets to prevent sheets below the single uppermost sheet from moving forward, and a follower rotatable member which contacts the feeding rotatable member and rotates together with the feeding rotatable member. The feeding rotatable member has a peripheral surface of a material which is harder than that of the separating rotatable member. The follower rotatable member has a peripheral surface made of a material having a coefficient of friction smaller than that of both the feeding rotatable member and the separating rotatable member. The width of the contact area, in the direction perpendicular to their rotational axes, between the separating rotatable member and the feeding rotatable member is larger than that between the follower rotatable member and the feeding rotatable member.

In the above construction of the automatic sheet feeding apparatus, the contact pressure between the feeding rotatable member and the follower rotatable member is higher than that between the feeding rotatable member and the separating rotatable member, and the follower rotatable member rotates together with the feeding rotatable member, whereby the oscillation of the separating rotatable member, as well as noise may be lowered and the single uppermost sheet, which is fed together with or without other sheets by the driven roller, can be nipped under a high pressure and fed by the rotatable members. The other sheets below the single uppermost sheet are prevented by the separating rotatable member from moving forward beyond the separating means. The follower rotatable member exerts hardly any unfavorable influence over the separating efficiency of the separating rotatable member, since the coefficient of friction of the peripheral surface of the follower rotatable member is smaller than that of the separating rotatable member.

Further, the construction of this apparatus may be very simply effected just by incorporating the follower rotatable member into a conventional separating means.

The feeding rotatable member may preferably be divided into parts in the direction perpendicular to its axis, i.e. parts which are in contact with the separating rotatable member and other parts which are in contact with the follower rotatable member, so that the former part has a peripheral surface harder than that of the latter part, whereby the abrasive wear on each part is substantially equalized during use.

BRIEF DESCRIPTION OF THE DRAWINGS

These and other objects and features of the present invention will become apparent from the following description of a preferred embodiment thereof taken in conjection with the accompanying drawings, in which.

DETAILED DESCRIPTION OF THE INVENTION

Figure 2:
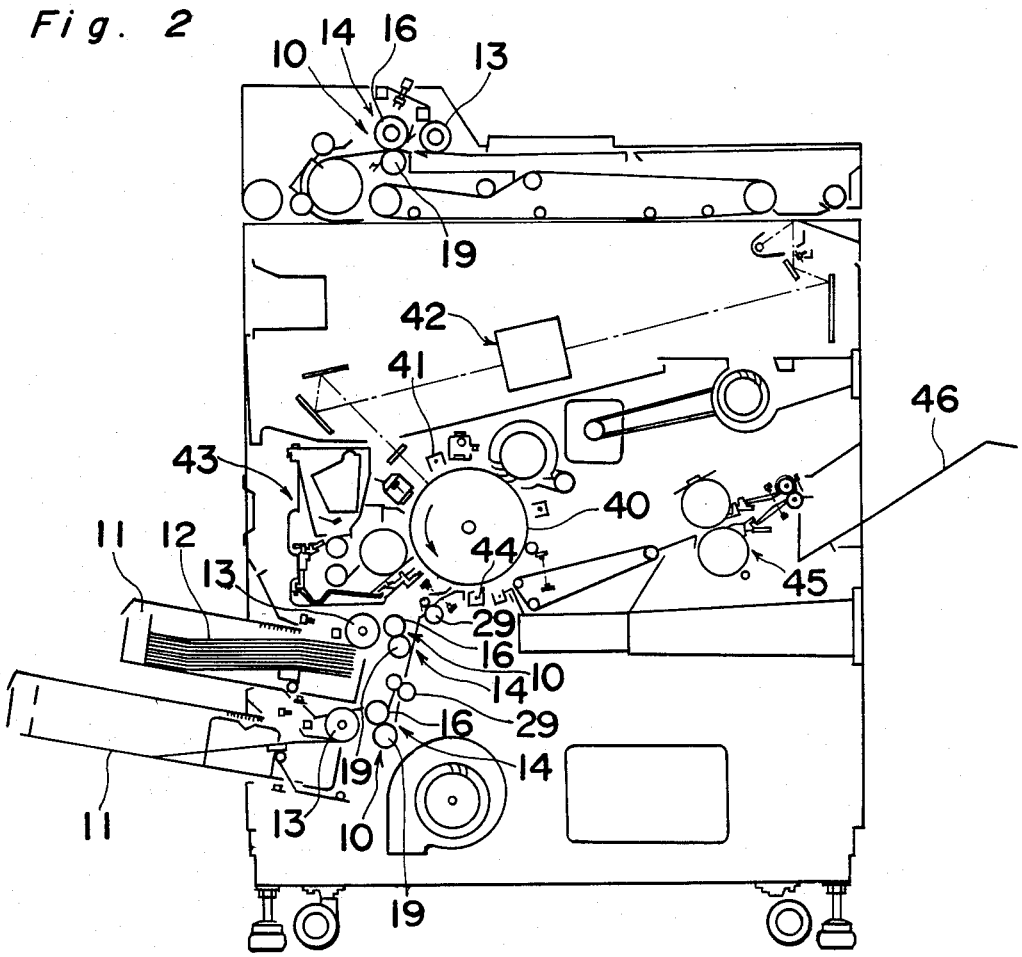
FIG. 2 is a schematic side sectional view of an electrophotographic copying machine to which an automatic sheet feeding apparatus in accordance with the present invention may be applied.

Referring to FIG. 2, there is shown the automatic sheet feeding apparatus according to the present invention as applied to each of two copying sheet feeding arrangements at the lower part and to a manuscript sheet feeding arrangement at the upper part in the electrophotographic copying machine.

The general construction of this electrophotographic copying machine is well known per se except for the automatic sheet feeding apparatus according to the present invention incorporated therein. The copying machine of FIG. 2 has a photosensitive or photoreceptor drum 40 which is rotatably provided at approximately a central portion of a machine housing for rotation in the counterclockwise direction, and around which there are sequentially disposed in a known manner, a corona charger 41 for preliminarily charging the surface of the photoreceptor drum 1, an optical system 42 for projecting an image of an original to be copied (not shown) onto the surface of the photoreceptor drum 1 so as to form an electrostatic latent image of the original thereon, a magnetic brush developing apparatus 43 for developing the electrostatic latent image into a visible toner image, and a transfer charger 44 for transferring the visible image onto a copying sheet which has been fed from one of two hopper bases 11. The sheet carrying a toner image thereon is fed to a receiving tray 46 after the toner image on the sheet has been fixed by the fixing device 45.

Referring further to FIGS. 3 to 6, there is shown an automatic sheet feeding arrangement according to a first embodiment which may be applied to the copy sheet feeding arrangement of the copying machine in FIG. 2. It is to be noted, however, that such an automatic sheet feeding apparatus as shown in FIGS. 3 to 6 can also be applied to the manuscript sheet feeding arrangement of the copying machine in FIG. 2 or a sheet feeding arrangement of another machine, such as a facsimile equipment, printer or the like.

In FIGS. 3 to 6, the automatic sheet feeding apparatus comprises a platform or hopper base 11 for accommodating thereon a stack of copying sheets, a driven roller 13 for feeding one or more sheets, for example two or three sheets, forward from the hopper base 11, a separating means 14 for separating one single uppermost sheet from a few other sheets which have been fed by the driven roller 13, and conveyance rollers 29 for receiving and feeding the single uppermost sheet to the following step.

Figure 3:
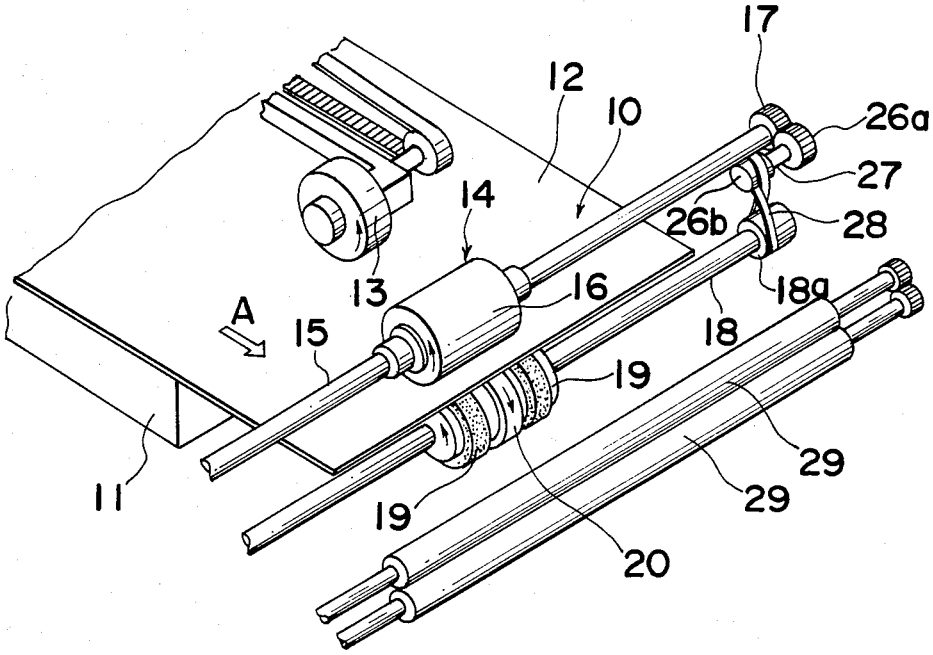
FIG. 3 is a perspective view of a automatic sheet feeding apparatus in accordance with one preferred embodiment of the present invention.
Figure 4:
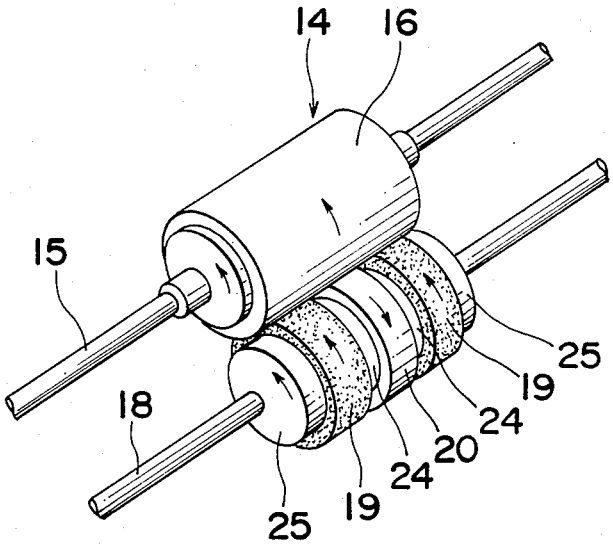
FIG. 4 is a fragmentary perspective view showing a sheet separating means employed in the automatic sheet feeding apparatus of FIG. 3, FIGS. 5 and 6 are respectively sectional views of the sheet separating means of FIG. 4, FIGS. 7, 8, 9, 10, 11 and 12 are respectively perspective views of the sheet separating means in accordance with other embodiments of this invention.

The driven roller 13 contacts the uppermost sheet 12 under a small pressure and rotates in the counterclockwise direction so that the sheet 12 will move in the forward, direction, shown by an arrow A in FIG. 3, together with or without other one or more sheets below the single uppermost sheet 12.

The separating means 14 comprises a feeding roller 16 which is fixedly mounted on a rotating shaft 15, and two separating rollers 19 and a follower roller 20 which are mounted around a rotating shaft 18 by means of a core 22.

The feeding roller 16 is arranged to rotate together with the shaft 15 in the counterclockwise direction to feed the top sheet 12 forward, and is made of general rubber material with a hardness at 30 to 50 degrees.

On the other hand, the separating rollers 19 are fixedly mounted on the core 22 in spaced relation to each other by means of outer spacers 25 and inner spacers 24 respectively as shown. Each of the separating rollers 19 together with the shaft 18 and the core 22 rotates in the same direction as the direction of movement of the shaft 12 to prevent the few sheets carried along with the single uppermost sheet 12 from moving forward. The core 22 is secured to the shaft 18 via a unidirectional clutch 21 so as to freely rotate in the direction opposite to the direction of rotation of the shaft 18, whereby it becomes easy to remove sheets nipped by the rollers 19, 20 and 16 in the event the sheets are jammed up. Each of the separating rollers 19 is made of expanded material such as polyurethane foam or polypropylene foam, and has a peripheral surface with a coefficient of friction and rubber hardness respectively smaller than those of the feeding roller 16.

The follower roller 20 is mounted around the core 22 between the spacers 24 via a slidable ring 23 to rotate in the opposite directions with respect to the core which rotates together with the shaft 18. The follower roller 20 has a peripheral surface which is made of polyacetal or covered by polytetrafluoroethylene (Teflon, name used in trade and manufactured by Du Pont Co., Ltd Japan) so that the peripheral surface has a coefficient of friction which is much smaller than that of the feeding roller 16 and the separating roller 19, and is also sufficiently hard not to deform upon receipt of contact pressure from the feeding roller 16.

Figure 5:
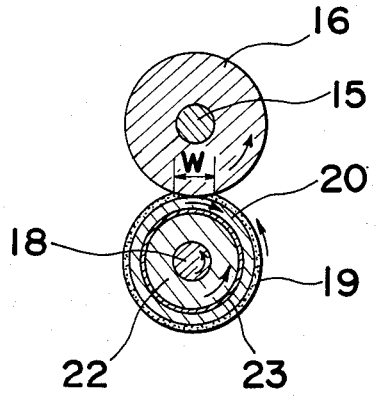
Figure 6:
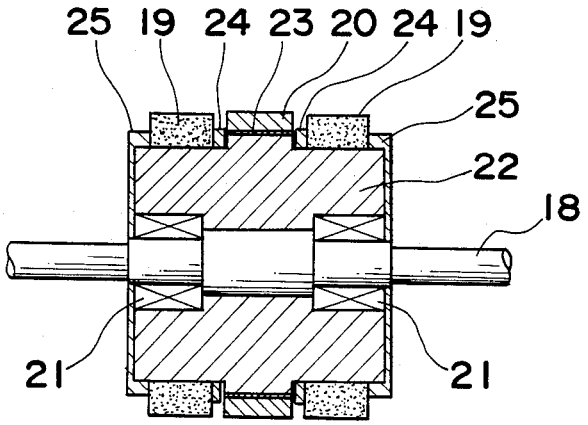

The shafts 15 and 18 respectively have a gear 17 and gear 18*a* at their corresponding ends. The gear 17 engages a gear 26*a* fixedly mounted on a countershaft 27. On the other hand, the gear 18*a* is connected to another gear 26*b* fixedly mounted on the countershaft 27 by a belt formed with corresponding teeth on its inner surface. Accordingly, when the shaft 15 is driven to rotate in the counterclockwise direction, the other shaft 18 rotates in the same direction. Each of the separating rollers 19 has an outer diameter which is the same as or slightly larger than that of the follower roller 20. Besides, as described earlier, the peripheral portion of each separating roller 19 is made softer than that of the follower roller 20. Therefore, as shown in FIG. 5, the feeding roller 16 contacts both separating rollers 19 and the follower roller 20 under a pressure in such a manner that the nipping width of contact area W between the rollers 16 and 19 is larger than that between the rollers 16 and 20.

When the single uppermost sheet 12 is fed together with a few other sheets by the driven roller 13, and its leading edge reaches the separating means, a sheet feeding force is given to the uppermost sheet 12 by the feeding roller 15, while on the other hand, a backward force is given to other sheets below the top sheet following the uppermost sheet 12 by the separating rollers 19. Under the above condition, it is apparent that the contact pressure between the rollers 16 and 20 is larger than that between the rollers 16 and 19 as the peripheral portion of the follower roller 20 is harder than that of the separating rollers 19 as described earlier. Besides, since the follower roller 20 is adapted to rotate together with the feeding roller 16, even if the feeding roller 16 and the separating rollers 19 repel each other and further the sheet to be dealt with is thin and limp, the top sheet 12 is positively fed forward by the rollers 16 and 20. Furthermore, the follower roller 20, the rotating direction of which is opposite to the separating rollers 19, exercises no unfavorable influence on the separating efficiency of the separating rollers 19, since the coefficient of friction of the peripheral portion of the follower roller 20 is appreciably small as compared with that of the separating rollers 19, as described previously. Therefore, according to this separating means, it is ensured that only the single uppermost sheet 12 is fed forward and other sheets are prevented from moving forward.

Figure 7:
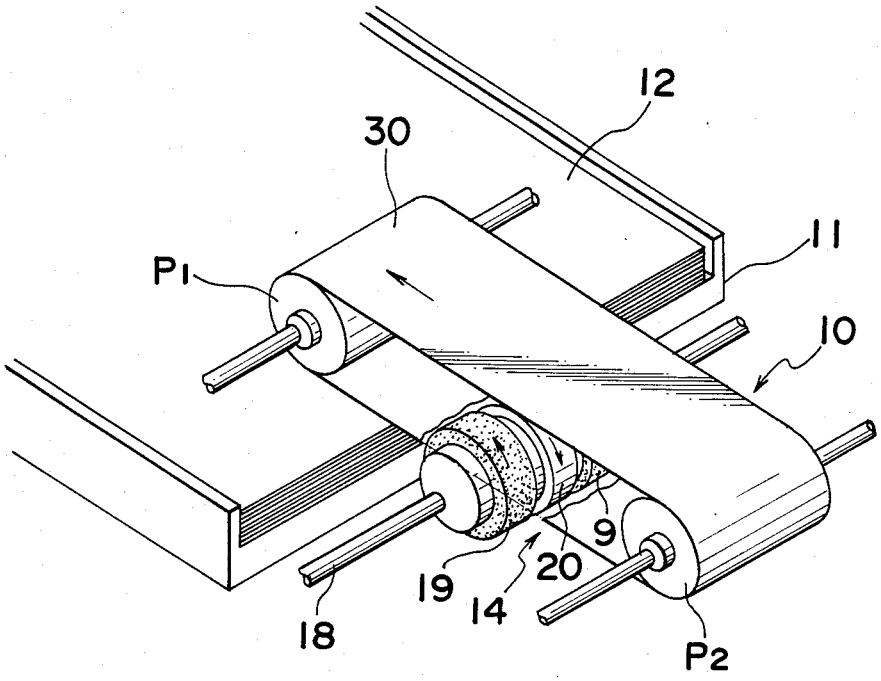

Reference is further made to FIG. 7 which shows a second embodiment according to the present invention. In this embodiment, the feeding roller 16 described as employed in the first embodiment of FIGS. 3 to 6 has been replaced by an endless belt 30. The belt 30 is supported by a pair of pulleys P1 and P2 for movement in the counterclockwise direction in contact with the separating rollers 19 and the follower roller 20 under pressure. The belt 30 has the same function as that of the feeding roller 16.

Figure 8:
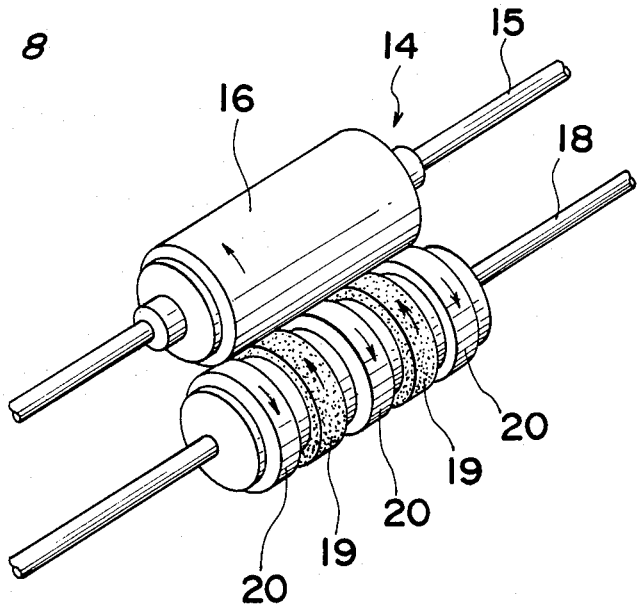

In the embodiments of FIGS. 3 to 7, although the number of the follower rollers 20 employed is described as being one, the number of follower rollers may be increased, for example, to two or three as shown in the third embodiment of FIG. 8. In FIG. 8, three follower rollers 20 are mounted around the core with a separating roller 19 placed between each adjacent pair.

Figure 9:
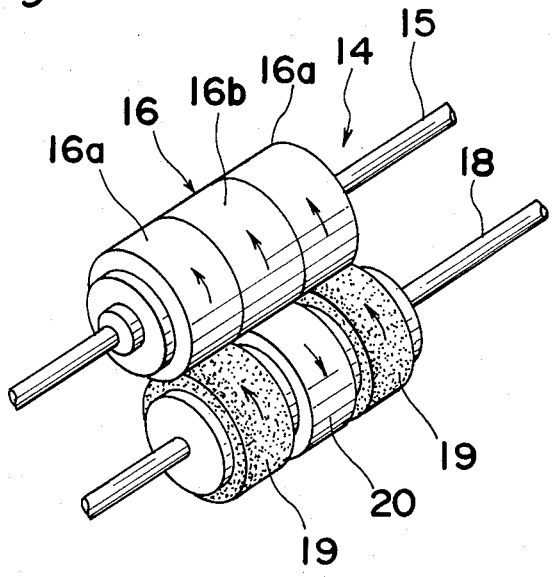

Referring further to FIG. 9 there is shown a fourth embodiment of the present invention wherein the feeding roller 16 is divided into three parts along the axis thereof, the opposite end parts 16*a* and 16*a* respectively cooperating with corresponding separating rollers 19, and a middle part 16*b* cooperating with the follower roller 20, the three parts being fixedly mounted on the shaft 15 so as to rotate together. Under this condition, each of the end parts 16*a* has a rubber hardness which is higher than that of the other part 16*b* so that both the abrasive wear of each part 16*a* in contact with the separating roller 19 and of the other part 16*b* in contact with the follower roller 20 are substantially equalized. In the manner as described above, the life of the feeding roller 16 can be advantageously prolonged, while simultaneously, the repulsion between the parts 16*a* and the separating roller 19 can be reduced.

Accordingly, the oscillation due to the repulsion is reduced to ensure a stable feeding force as well as a stable separating force.

Figure 10:
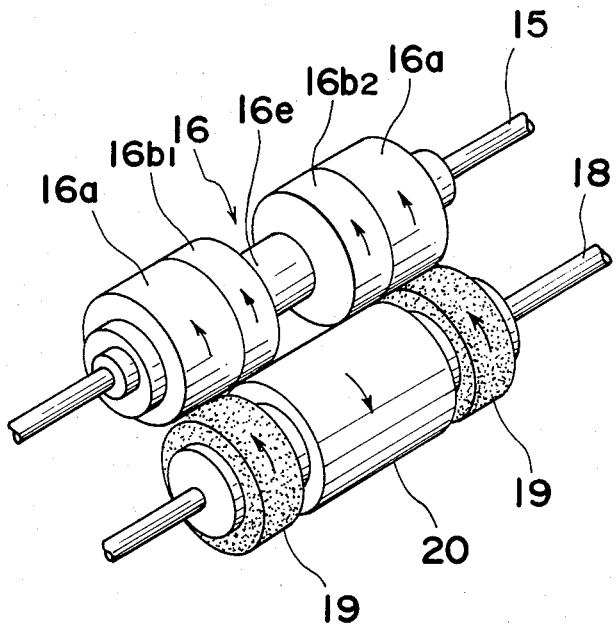

In FIG. 10, there is shown a modification of the separating means shown in FIG. 9, wherein the part 16*b* of the feeding roller 16 described as cooperating with the follower roller 20 in the arrangement of FIG. 9 is further divided into two parts 16*b*1 and 16*b*2. The two parts 16*b*1 and 16*b*2 are arranged around the shaft 15 in a spaced relationship to each other so that, for instance, a driven belt (not shown) may be engaged with the intermediate part of the shaft 16*e* between the two parts 16*b*1 and 16*b*2 to rotate the shaft 15. This construction is preferable when it is difficult to arrange a shaft driving mechanism at the end portion of the shaft 15. It is to be noted that the length of the follower roller 20 in the axial direction should be increased so as to contact both of the parts 16*b*1 and 16*b*2 of the feeding roller 16.

Figure 11:
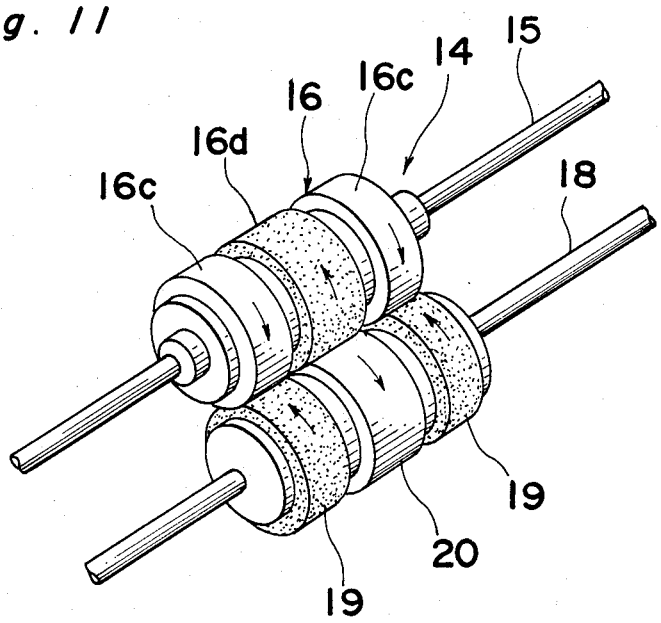

FIG. 11 shows a further modification of the separating means shown in FIG. 9, wherein, the feeding roller 16 is further divided into three parts 16*c*, 16*d* and 16*c* along the axis thereof. The middle part 16*d* which cooperates with the follower roller 20, is fixedly mounted on the shaft 15 and is made of the same material as the feeding roller 16 shown in FIG. 9. On the other hand, each of the outside parts 16*c* and 16*c* which cooperates with a corresponding one of the separating rollers 19, is formed as a follower roller and made of the same material as that of the follower roller 20. According to this modification, the abrasive wear of each of the parts 16*c*, 16*d* and 16*c* of the feeding roller 16 can be substantially equalized in a similar manner as in the embodiment shown in FIG. 3, while no repulsion between the part 16*c* of the feeding roller 16 and the corresponding separating roller 19 takes place, so that a stable sheet feeding force is provided to the uppermost sheet 12 and, on the other hand, a stable backward force is provided to other sheet below the uppermost sheet 12.

Figure 12:
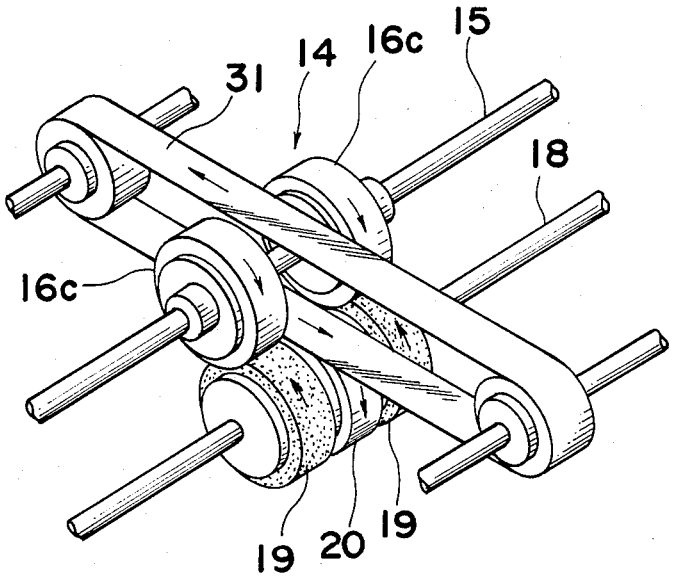

The part 16*d* of the feeding roller 16 in FIG. 11 may be replaced by an endless belt 31 shown in FIG. 12 which is similar to the endless belt 30 shown FIG. 7.

Figure 1:
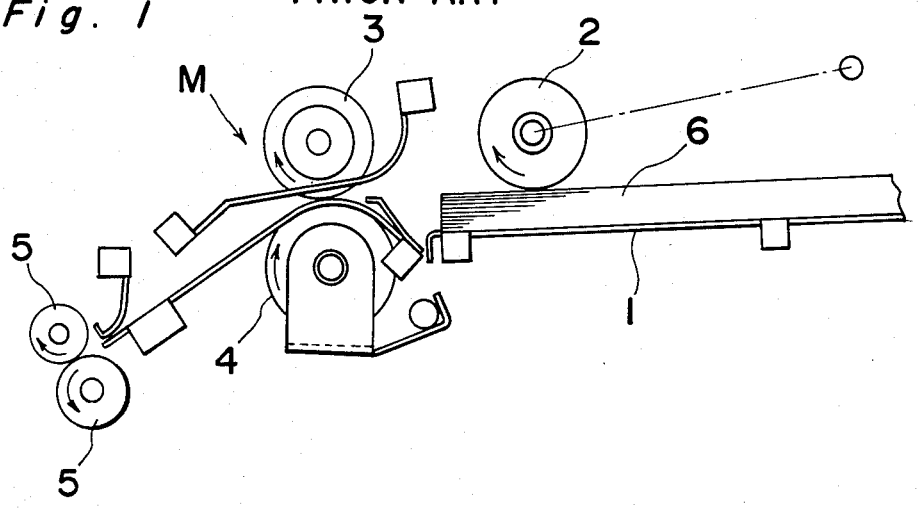
PRIOR ART Fig. 1
FIG. 1 is a schematic side elevational view of a conventional automatic sheet feeding apparatus (already referred to)
Figure 13:
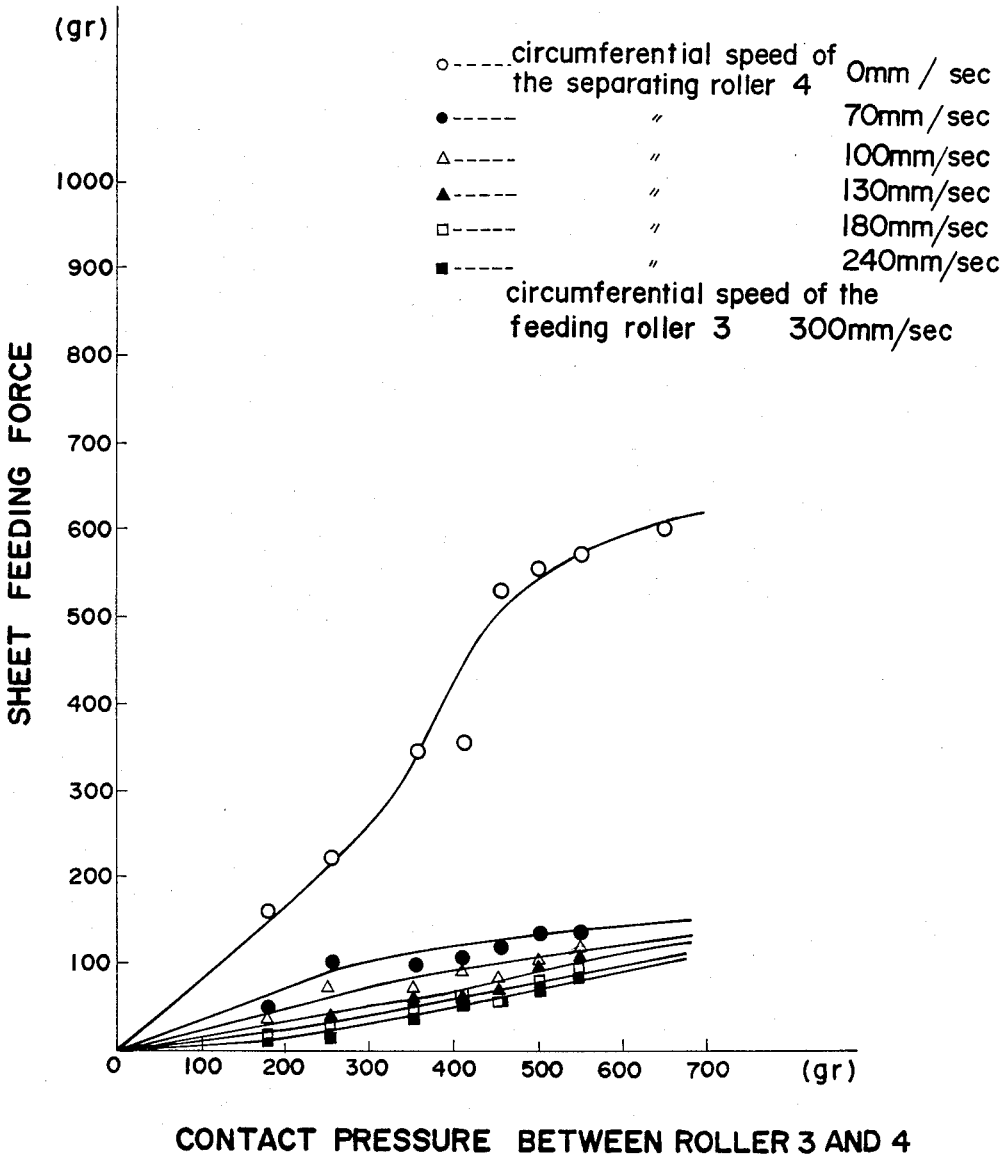
Fig. 13 PRIOR ART
FIG. 13 is a graph showing characteristic curves of a conventional sheet separating means.
Figure 14:
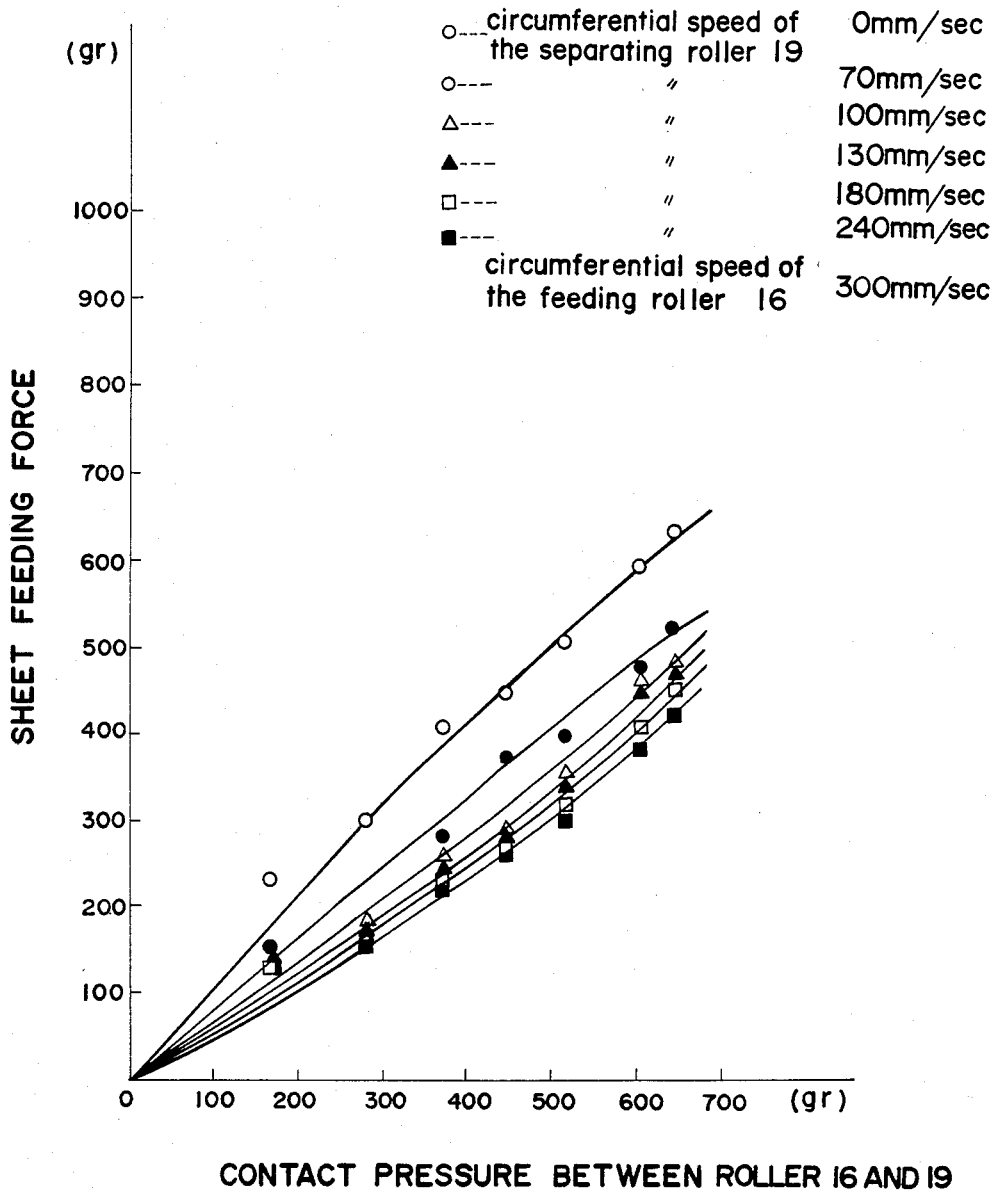
FIG. 14 is a graph showing characteristic curves of the sheet separating means in accordance with the present invention.

FIGS. 13 and 14 respectively show characteristic curves of the conventional sheet feeding apparatus shown in FIG. 1 and of the sheet feeding apparatus in accordance with the present invention. In FIGS. 13 and 14, the abscissa and ordinate represent the contact pressure between the roller 3 and 4 or 16 and 19 and the sheet feeding force of the separating means. It will be seen from FIGS. 13 and 14 that, according to the conventional sheet feeding apparatus, when the separating roller 19 starts rotating, the sheet feeding force for the single uppermost sheet 12 deteriorates suddenly, while according to the present invention even if the separating roller starts rotating, the reduction of the feeding force for the top sheet 12 is quite small. This means that in the sheet feeding apparatus according to the present invention, the repulsion between the feeding roller 16 and the separating roller 19 is kept small.

As is clear from the foregoing description, according to the present invention, the oscillation of the separating rotatable member as well as noise can be lowered and the single uppermost sheet, which is fed together with or without other sheets by the driven roller, can be nipped under a high pressure and fed by the feeding rotatable member and the follower rotatable member, while the other sheets below the single uppermost sheet can be prevented by the separating rotatable member from moving forward beyond the separating means, and further, the construction of this apparatus may be very simply effected by incorporating the follower rotatable member into a conventional separating means.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An automatic sheet feeding apparatus for use in a copying machine and the like which comprises: a hopper base for accommodating stack of sheet material thereon; a driven roller for feeding the sheet material in the hopper base forward one by one; a sheet separating means for receiving the sheets fed by the driven roller and separating a single uppermost sheet from other sheets below the uppermost sheet and also feeding the uppermost sheet forward; and conveyance rollers for feeding the top sheet fed by the separating means forward, said separating means comprising a feeding rotatable member which rotates in the direction of movement of the sheets to feed the single uppermost sheet forward, a separating rotatable member which contacts the feeding rotatable member and rotates in the direction opposite to the movement of sheets to prevent the sheets below the uppermost sheet from moving forward, and a follower rotatable member which contacts the feeding rotatable member and rotates together with the feeding rotatable member, said feeding rotatable member having a peripheral surface which is harder than that of the separating rotatable member, said follower rotatable member having a peripheral surface of a material having coefficient of friction smaller than that of each of the feeding rotatable member and the separating rotatable member, and the width of the contact area, in the direction perpendicular to the rotational axes of said rotatable members, between the separating rotatable member and the feeding rotatable member being greater than that between the follower rotatable member and the feeding rotatable member.

2. An automatic sheet feeding apparatus as claimed in claim 1, wherein said separating rotatable member and follower rotatable member respectively comprise rollers mounted around a corresponding rotating shaft.

3. An automatic sheet feeding apparatus as claimed in claim 2, wherein said separating roller and said follower roller are mounted around a core which is rotatably mounted around the corresponding rotating shaft to rotate in the direction opposite to the advance of the sheet with respect to said shaft.

4. An automatic sheet feeding apparatus as claimed in claim 3, wherein said follower roller is rotatably mounted around said core on a slidable ring to rotate in the opposite direction to said core.

5. An automatic sheet feeding apparatus as claimed in claim 2, wherein said separating means includes two separating rollers arranged in a spaced relationship from each other and a follower roller arranged in the space between the two separating rollers.

6. An automatic sheet feeding apparatus as claimed in claim 2 further including three follower rollers in a spaced relationship from each other and two separating rollers each of which is arranged in a space between two adjacent separating rollers.

7. An automatic sheet feeding apparatus as claimed in claim 2, 3, 4, 5 or 6 wherein said feeding rotatable member comprises a roller mounted around a rotating shaft.

8. An automatic sheet feeding apparatus as claimed in claim 2, 3, 4, 5 or 6 wherein said feeding rotatable member comprises an endless belt.

9. An automatic sheet feeding apparatus as claimed in claim 1, wherein said apparatus is a copy sheet feeding arrangement of a copying machine.

10. An automatic sheet feeding apparatus as claimed in claim 1, wherein said apparatus is a manuscript sheet feeding arrangement of a copying machine.

11. An automatic sheet feeding apparatus for use in a copying machine and the like which comprises: a hopper base for accommodating a stack of sheet material therein; a driven roller for feeding the sheet material on the hopper base forward one by one; a sheet separating means for receiving the sheets fed by the driven roller and separating a single uppermost sheet from other sheets below the uppermost sheet and also feeding the single uppermost sheet forward; and conveyance rollers for feeding the single uppermost sheet fed by the separating means forward, said separating means comprising a feeding rotatable member which rotates in the direction of movement of the sheets to feed the single uppermost sheet forward, a separating rotatable member which contacts the feeding rotatable member and rotates in the direction opposite to the movement of sheets to prevent the sheets below the single uppermost sheet from moving forward, and a follower rotatable member which contacts the feeding rotatable member and rotates together with the feeding rotatable member, said feeding rotatable member being divided in parts in the axial direction thereof with each part cooperating with a corresponding one of the separating rotatable member and the follower rotatable member, said part cooperating with the separating rotatable member having a peripheral surface which is harder than that of the part which cooperates with the follower rotatable member so that the abrasive wear of each part is substantially equalized, said follower rotatable member having a peripheral surface of a material having a coefficient of friction smaller than that of each of the feeding rotatable member and the separating rotatable member, and the width of the rotational axes of said rotatable members, between the separating rotatable member and the feeding rotatable member being larger than that between the follower rotatable member and the feeding rotatable member.

12. An automatic sheet feeding apparatus as claimed in claim 11, wherein said separating rotatable member and the follower rotatable member respectively comprise rollers mounted around corresponding rotating shafts.

13. An automatic sheet feeding apparatus as claimed in claim 12, wherein said feeding rotatable member comprises a roller member around a rotating shaft.

14. An automatic sheet feeding apparatus as claimed in claim 12, wherein the parts of the feeding roller are arranged in a spaced relationship from each other driving means can engage the part of the shaft between feeding rollers to rotate it.

15. An automatic sheet feeding apparatus as claimed in claim 12, wherein said part which cooperates with the separating roller is a follower roller which rotates together with the separating roller.

16. An automatic sheet feeding apparatus as claimed in claim 12, wherein said part which cooperates with the follower roller comprises an endless belt.

* * * * *